US012644457B2

(12) United States Patent
Chen et al.

(10) Patent No.: US 12,644,457 B2
(45) Date of Patent: Jun. 2, 2026

(54) COMPRESSOR STRUCTURE

(71) Applicant: Fu Sheng Industrial Co. Ltd., Taipei City (TW)

(72) Inventors: TaiYu Chen, Taipei City (TW); Yu-Feng Wu, Taipei City (TW)

(73) Assignee: Fu Sheng Industrial Co. Ltd., Taipei City (TW)

( * ) Notice: Subject to any disclaimer, the term of this patent is extended or adjusted under 35 U.S.C. 154(b) by 0 days.

(21) Appl. No.: 19/278,786

(22) Filed: Jul. 24, 2025

(65) Prior Publication Data

US 2026/0146610 A1 May 28, 2026

(30) Foreign Application Priority Data

Nov. 22, 2024 (TW) ..... 113145166

(51) Int. Cl.
*F04C 29/02* (2006.01)
*F04C 18/16* (2006.01)
*F04C 29/00* (2006.01)

(52) U.S. Cl.
CPC ..... *F04C 29/026* (2013.01); *F04C 18/16* (2013.01); *F04C 29/0007* (2013.01)

(58) Field of Classification Search
CPC .. F01C 21/007; F04C 29/026; F04C 29/0007; F04C 29/02; F04C 29/12; F04C 29/028; F04C 29/042; F04C 18/12; F04C 18/16; F04C 23/008; F04C 2240/30
See application file for complete search history.

(56) References Cited

U.S. PATENT DOCUMENTS 5,401,149 A * 3/1995 Tsuru ..... F04C 18/16 418/179
5,613,843 A * 3/1997 Tsuru ..... F04C 23/00 417/360

(Continued)

FOREIGN PATENT DOCUMENTS

CA 2363745 8/2002
CN 101943163 1/2011

(Continued)

OTHER PUBLICATIONS

"Search Report of Europe Counterpart Application", issued on Feb. 2, 2026, p. 1-p. 8.

(Continued)

*Primary Examiner* — Dapinder Singh
(74) *Attorney, Agent, or Firm* — JCIPRNET

(57) ABSTRACT

A compressor structure including a compressor housing, an oil tank, an oil-gas barrel, a motor, a first assembly base, at least one oil filter, a second assembly base, and at least one oil mist separator is provided. The compressor housing has a compression chamber. The oil tank is disposed below the compressor housing. The oil-gas barrel is communicated with the oil tank. The first assembly base has a discharge passage, and the compression chamber is communicated with the oil-gas barrel through the discharge passage. The oil filter is disposed on the first assembly base and is communicated with the compression chamber through the first assembly base. The second assembly base is disposed on the oil-gas barrel. The oil mist separator is disposed on the second assembly base and is communicated with the oil-gas barrel through the second assembly base.

20 Claims, 14 Drawing Sheets

(56) References Cited

U.S. PATENT DOCUMENTS

| | | | | |
|---|---|---|---|---|
| 11,732,715 | B2 * | 8/2023 | Crum | F04C 18/16 418/83 |
| 12,510,074 | B2 * | 12/2025 | Covel | F04C 18/0215 |
| 12,540,620 | B2 * | 2/2026 | Bautista Rodriguez | F04B 35/04 |
| 2004/0071562 | A1 * | 4/2004 | Dreiman | F04C 29/025 417/244 |
| 2005/0217221 | A1 | 10/2005 | Stickland et al. | |
| 2017/0045053 | A1 * | 2/2017 | Ge | F04C 18/16 |
| 2023/0116766 | A1 * | 4/2023 | Pu | H02K 1/32 310/54 |

FOREIGN PATENT DOCUMENTS

| | | |
|---|---|---|
| CN | 202646015 | 1/2013 |
| CN | 204532821 | 8/2015 |
| CN | 110678654 | 1/2020 |
| CN | 210484072 | 5/2020 |
| EP | 1229249 | 8/2002 |
| EP | 3719322 | 10/2020 |
| TW | M502746 | 6/2015 |
| TW | M667784 | 3/2025 |

OTHER PUBLICATIONS

"Office Action of Taiwan Counterpart Application", issued on Sep. 8, 2025, p. 1-p. 7.

* cited by examiner

100B

COMPRESSOR STRUCTURE

CROSS-REFERENCE TO RELATED APPLICATION

This application claims the priority benefit of Taiwan application serial no. 113145166, filed on Nov. 22, 2024. The entirety of the above-mentioned patent application is hereby incorporated by reference herein and made a part of this specification.

BACKGROUND

Technical Field

The disclosure relates to a compressor structure, and in particular relates to a compressor structure with an oil-gas separation design.

Description of Related Art

Screw compressors may be broadly categorized into oil-injected screw compressors and oil-free screw compressors. Although oil-free screw compressors may provide completely oil-free gas, they require higher gas quality standards, present greater maintenance difficulties, and involve higher manufacturing costs. Consequently, the application of oil-free screw compressors is not as widespread as that of oil-injected screw compressors.

During the operation of oil-injected screw compressors, lubricating oil is sprayed into the compression chamber to lubricate and cool the rotors within the compression chamber, thereby reducing the operating temperature. Initially, the lubricating oil sprayed into the compression chamber mixes with the gas entering the compression chamber and is compressed by the rotors. Subsequently, the mixed fluid formed by the lubricating oil and compressed gas is discharged from the compression chamber and enters the oil tank. When the mixed fluid enters the oil tank, it impacts the inner walls of the oil tank or other components within the oil tank to perform preliminary separation of the lubricating oil and compressed gas. However, the separation efficiency is generally poor, resulting in high oil-content gas entering the system and increasing lubricating oil consumption. Furthermore, when the compressed gas enters the oil tank, it impacts the lubricating oil surface within the oil tank, causing excessive fluctuation of the liquid surface, which affects the accurate determination of the oil quantity in the oil tank.

SUMMARY

A compressor structure, which helps to improve the oil-gas separation effect and significantly reduce the lubricating oil consumption, is provided in the disclosure.

A compressor structure including a compressor housing, an oil tank, an oil-gas barrel, a motor, a first assembly base, at least one oil filter, a second assembly base, and at least one oil mist separator is provided in the disclosure. The compressor housing has a compression chamber. The oil tank is disposed below the compressor housing. The oil-gas barrel is communicated with the oil tank, and the compressor housing and the oil tank are located at a same side of the oil-gas barrel. The motor and the first assembly base are respectively disposed at two opposite sides of the compressor housing. The first assembly base has a discharge passage, and the compression chamber is communicated with the oil-gas barrel through the discharge passage. The oil filter is disposed on the first assembly base and is communicated with the compression chamber through the first assembly base. The second assembly base is disposed on the oil-gas barrel. The oil mist separator is disposed on the second assembly base and is communicated with the oil-gas barrel through the second assembly base.

Based on the above, in the compressor structure of the disclosure, the mixed fluid formed by the lubricating oil and the compressed gas, after being discharged from the compression chamber, undergoes oil-gas separation sequentially in the discharge passage and the oil-gas barrel to separate the majority of the lubricating oil from the compressed gas, before entering the oil tank and the oil-gas barrel for storage. Therefore, the compressor structure of the disclosure may not only prevent compressed gas with high oil content from entering the system, but also reduce the lubricating oil consumption. On the other hand, the oil tank is disposed below the compressor housing, in which the oil-gas barrel is communicated with the oil tank, and the compressor housing and the oil tank are located at the same side of the oil-gas barrel, thereby improving the compactness of the structural configuration to reduce the volume and increasing the oil storage capacity of the compressor structure.

In order to make the above-mentioned features and advantages of the disclosure comprehensible, embodiments accompanied with drawings are described in detail below.

DETAILED DESCRIPTION OF DISCLOSED EMBODIMENTS

Figure 1A:
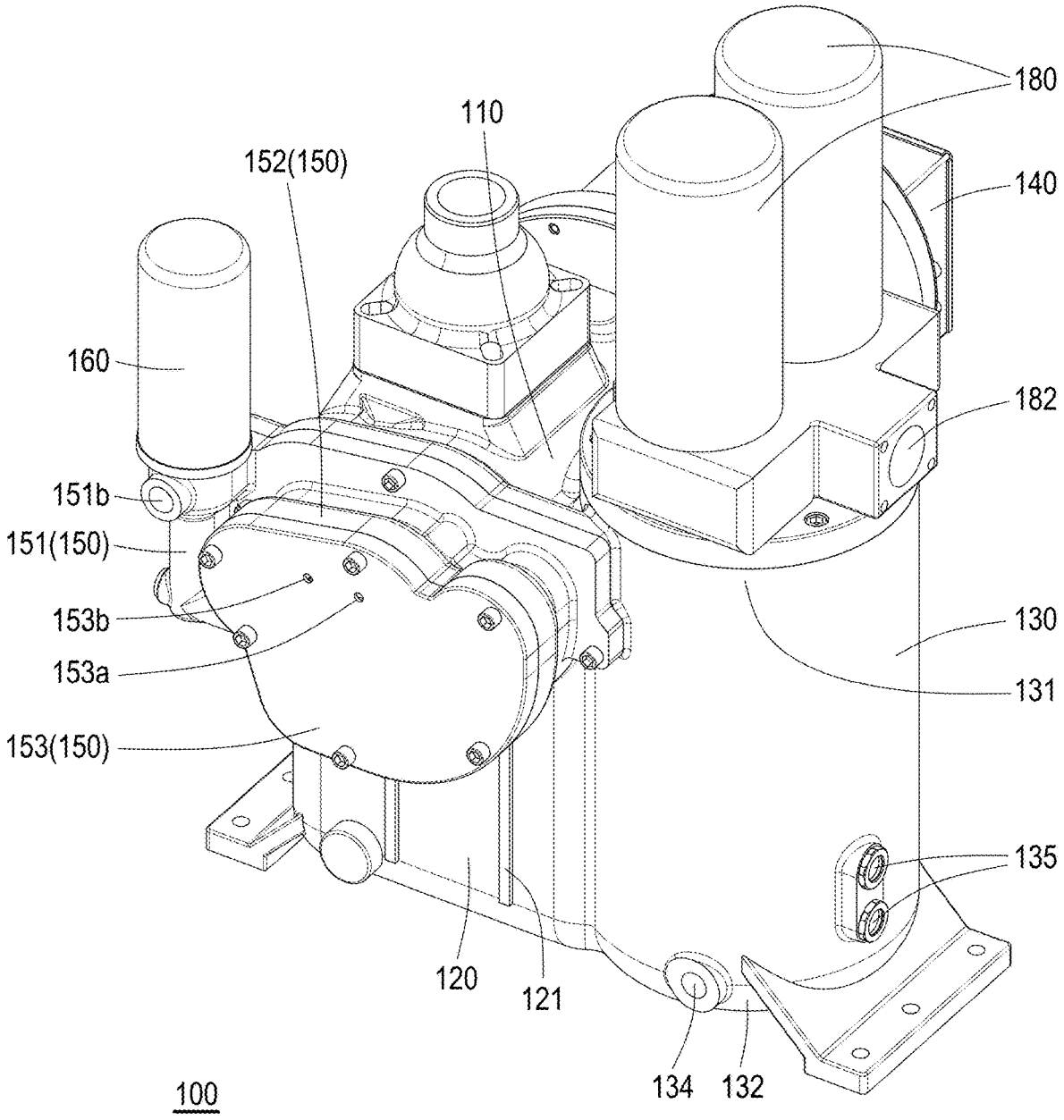
FIG. 1A and FIG. 1B are schematic diagrams of a compressor structure at two different viewing angles of an embodiment of the disclosure.
Figure 1B:
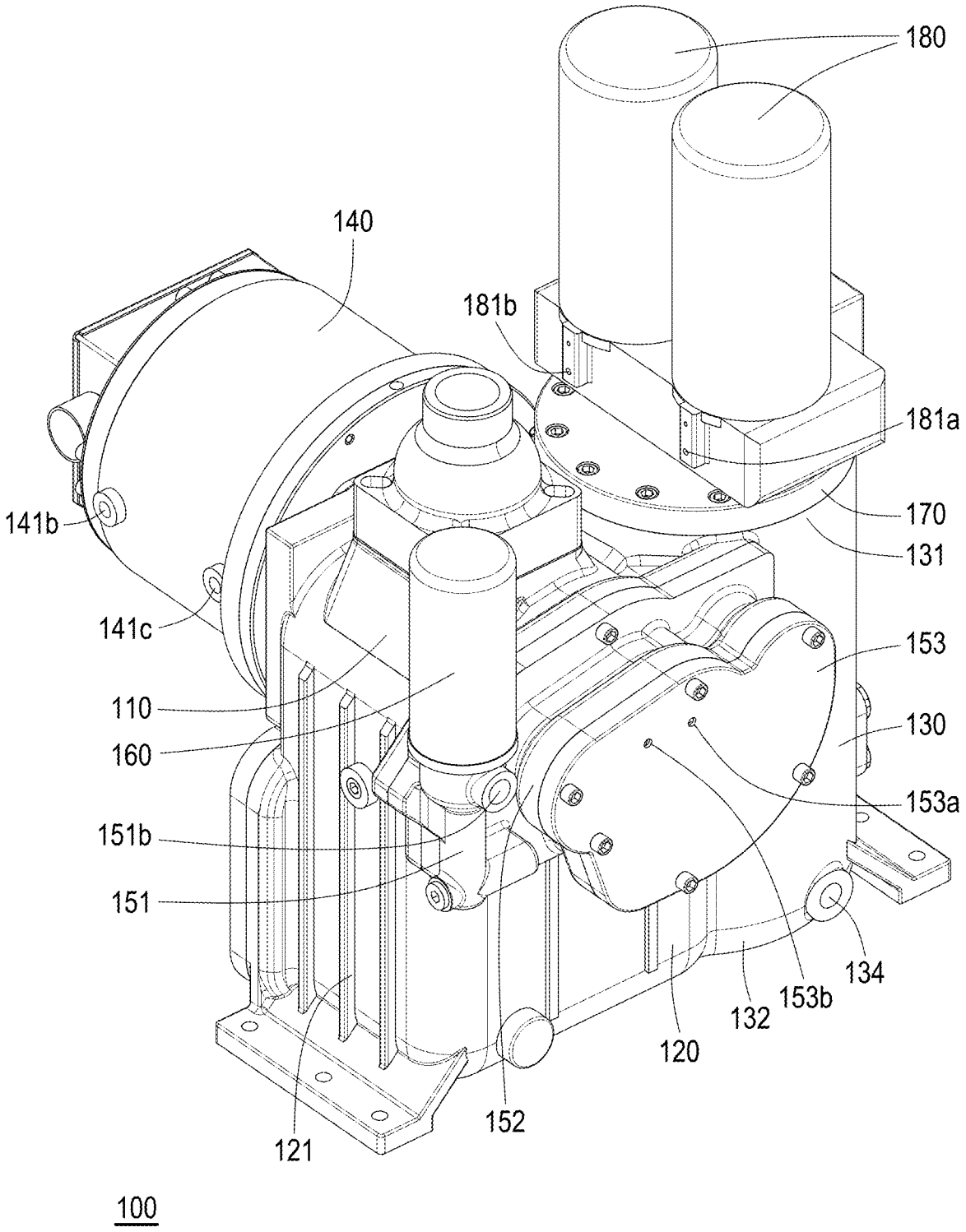

Referring to FIG. 1A and FIG. 1B, in this embodiment, the compressor structure 100 includes a compressor housing 110, an oil tank 120, an oil-gas barrel 130, a motor 140, a first assembly base 150, at least one oil filter 160, a second assembly base 170, and at least one oil mist separator 180.

Specifically, the oil tank 120 is disposed below the compressor housing 110, in which the oil-gas barrel 130 is communicated with the oil tank 120, and the compressor housing 110 and the oil tank 120 are located at the same side of the oil-gas barrel 130, thereby improving the compactness of the structural configuration to reduce the volume.

As shown in FIG. 1A, FIG. 1B, FIG. 2A and FIG. 2B, the motor 140 and the first assembly base 150 are respectively disposed at two opposite sides of the compressor housing 110. The oil filter 160 is disposed on the first assembly base 150 and is located outside the first assembly base 150. In addition, the second assembly base 170 is disposed on the oil-gas barrel 130. The oil mist separator 180 is disposed on the second assembly base 170 and is located outside the second assembly base 170. Based on the above assembly configuration, the compactness of the structural configuration may be improved to reduce the volume.

For example, the first assembly base 150 may be fixed to the compressor housing 110 by bolts, screws or other fixing parts. In addition, the second assembly base 170 may be fixed to the top portion 131 of the oil-gas barrel 130 by bolts, screws or other fixing parts.

Figure 1C:
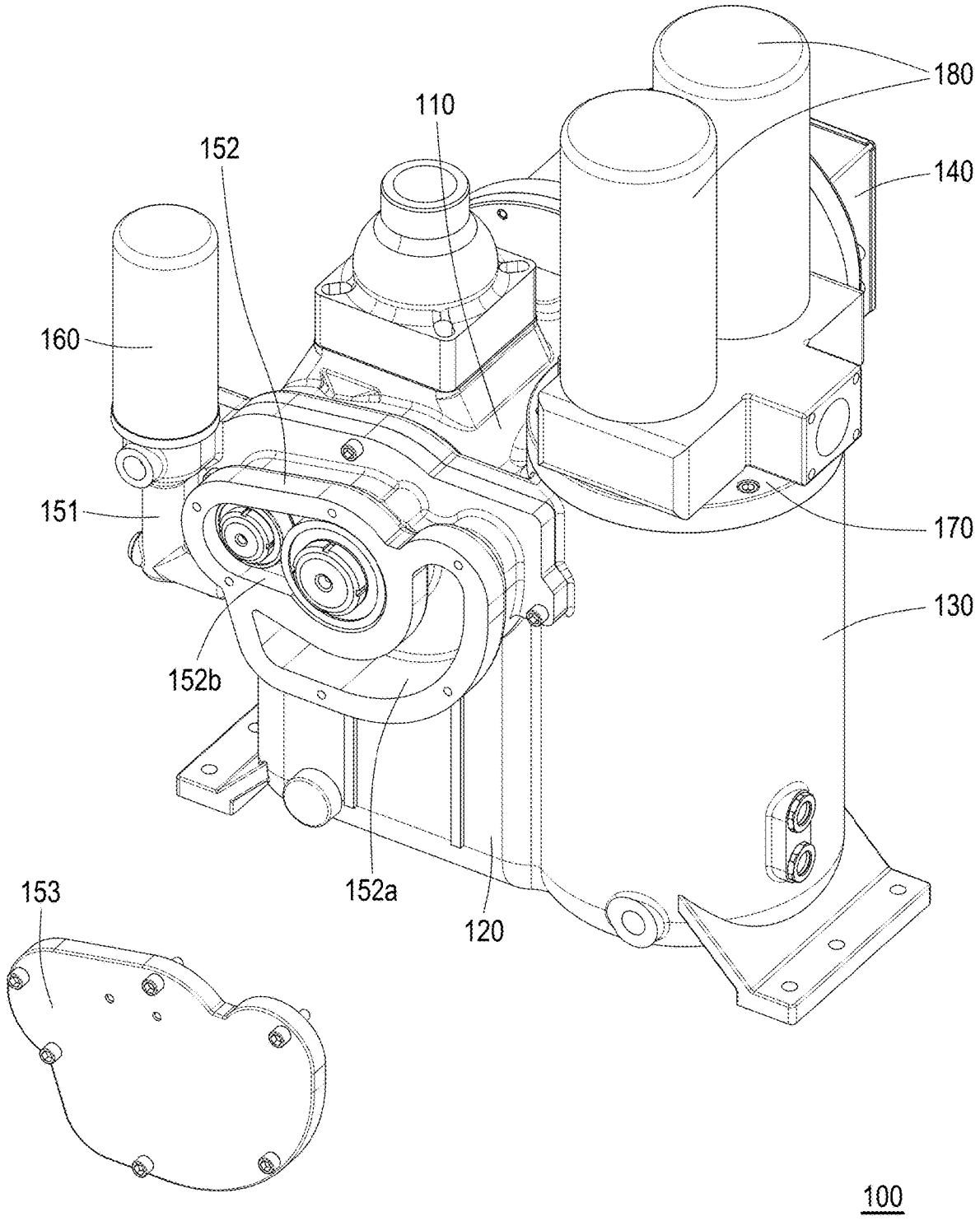
FIG. 1C is a schematic diagram of the bearing base cover of FIG. 1A being detached from the bearing base.
Figure 1D:
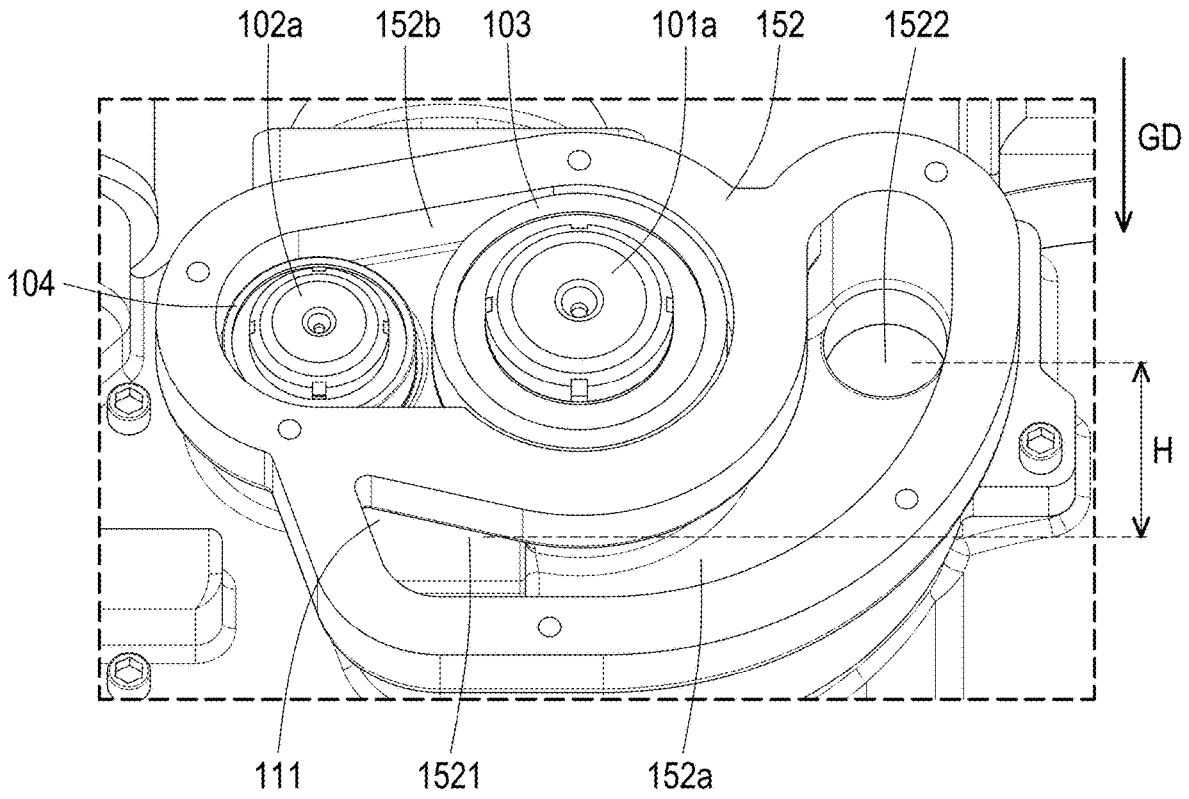
FIG. 1D is a partially enlarged schematic diagram of the bearing base of FIG. 1C at another viewing angle.
Figure 1E:
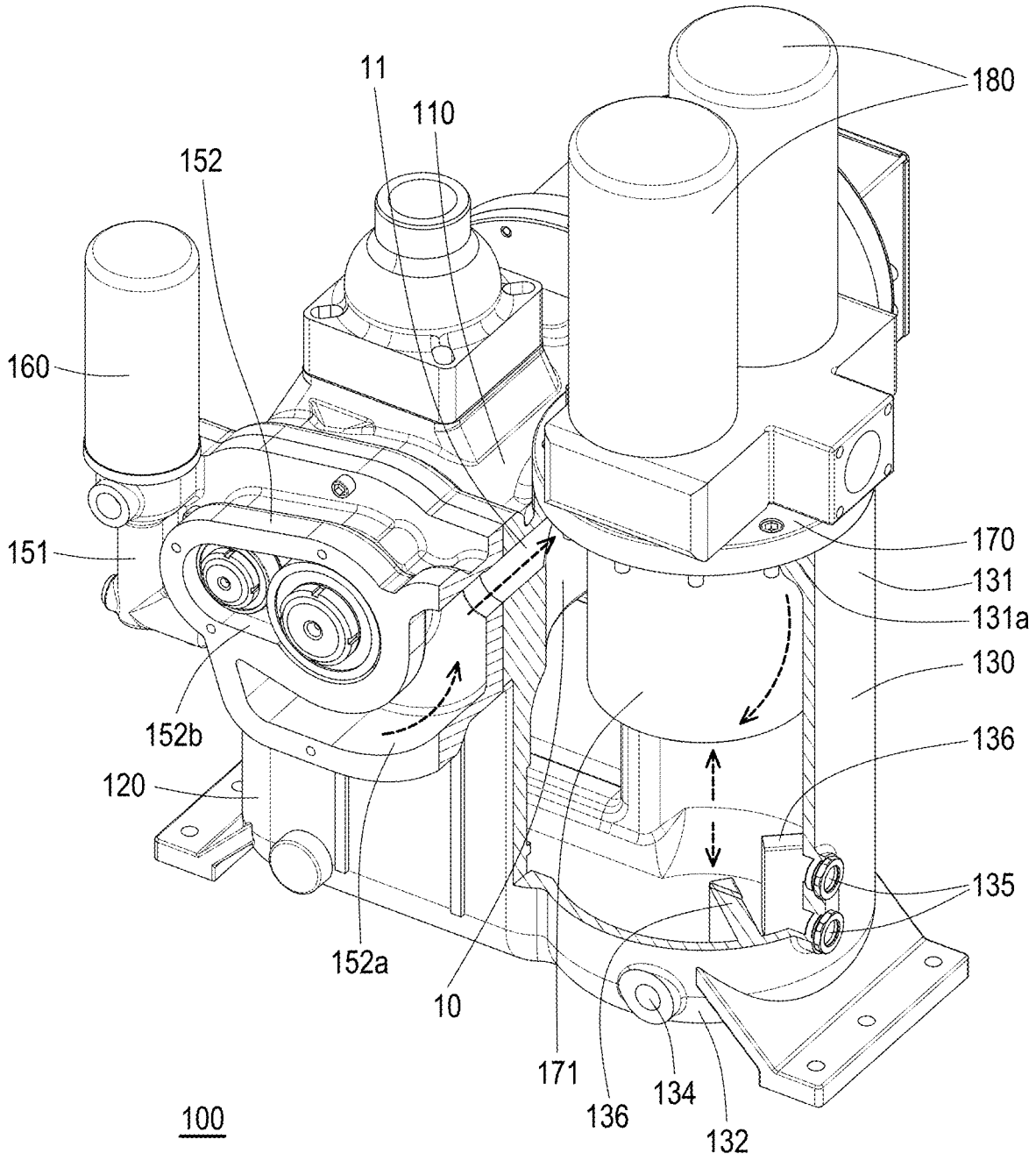
FIG. 1E is a partial cross-sectional schematic diagram of FIG. 1C.

As shown in FIG. 1B to FIG. 1D, the first assembly base 150 includes an oil filter base 151 and a bearing base 152. The oil filter 160 is disposed on the oil filter base 151, and the first assembly base 150 has a discharge passage 152*a* and a bearing assembly space 152*b* formed at the bearing base 152. As shown in FIG. 1C to FIG. 1E, the discharge passage 152*a* is separated from the bearing assembly space 152*b*, the discharge passage 152*a* extends from bottom to top along an arc path toward the oil-gas barrel 130 at the periphery of the bearing assembly space 152*b*, and the compression chamber 111 of the compressor housing 110 is communicated with the oil-gas barrel 130 through the discharge passage 152*a*.

As shown in FIG. 1D, FIG. 1E, FIG. 2B and FIG. 2C, in this embodiment, the compressor structure 100 further includes a first rotor 101 and a second rotor 102 disposed in parallel in the compression chamber 111 and a first bearing 103 and a second bearing 104 disposed in parallel in the bearing assembly space 152*b*. The first rotor 101 is coupled to the motor 140, and the first rotor 101 and the second rotor 102 may be two screws meshing with each other. On the other hand, the end 101*a* of the first rotor 101 is inserted into the bearing assembly space 152*b*, and the first bearing 103 is sleeved on the end 101*a* of the first rotor 101. The end 102*a* of the second rotor 102 is inserted into the bearing assembly space 152*b*, and the second bearing 104 is sleeved on the end 102*a* of the second rotor 102.

For example, the first rotor 101 and the second rotor 102 meshing with each other may be disposed horizontally in a left-right configuration, but not limited thereto. The first rotor 101 and the second rotor 102 meshing with each other may also be disposed vertically in an up-down configuration, or may be positioned such that their respective long axes (or rotational axes) have a vertical offset in the gravitational direction GD.

Figure 2A:
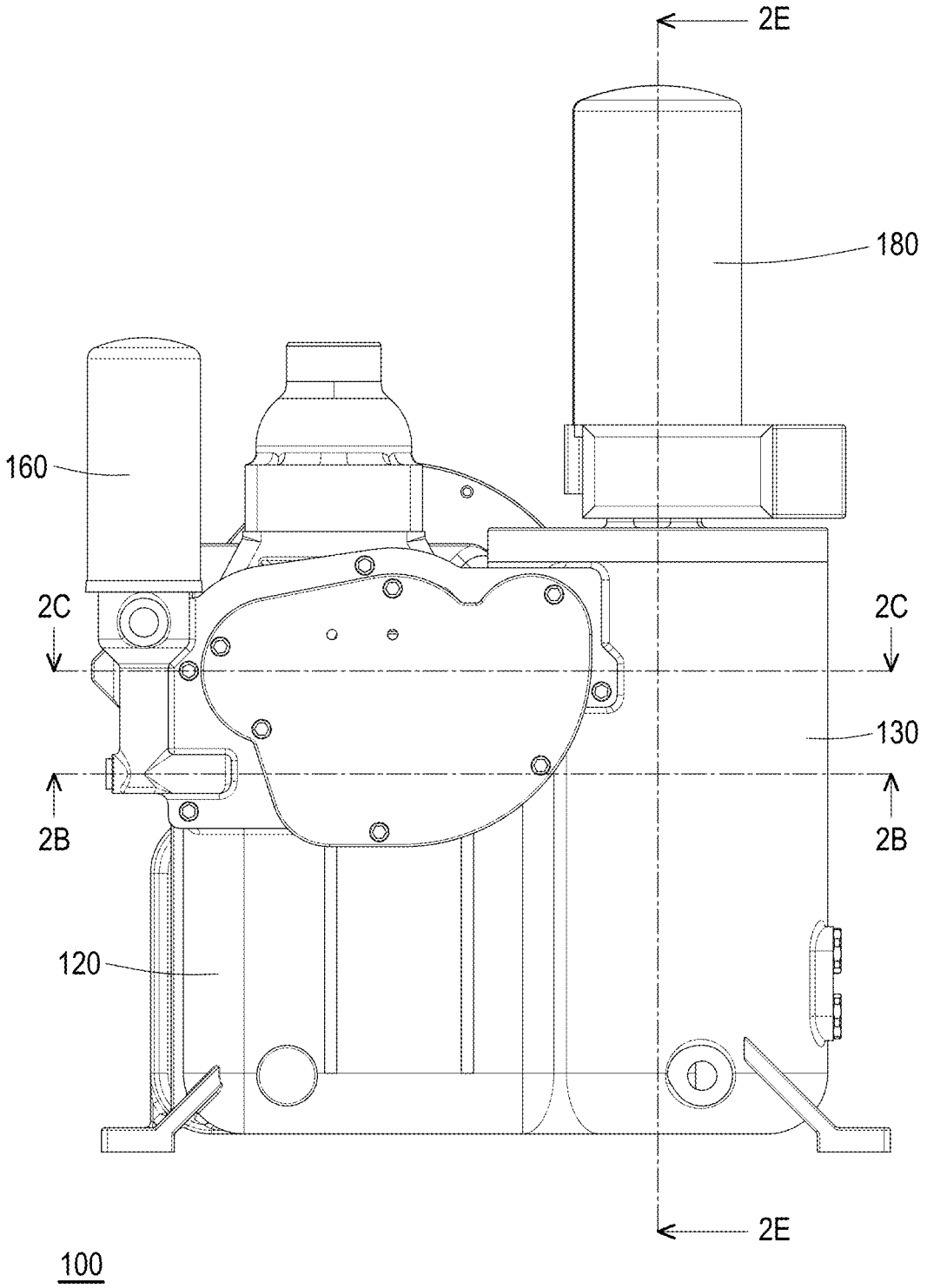
FIG. 2A is a front view schematic diagram of the compressor structure of FIG. 1A.
Figure 2B:
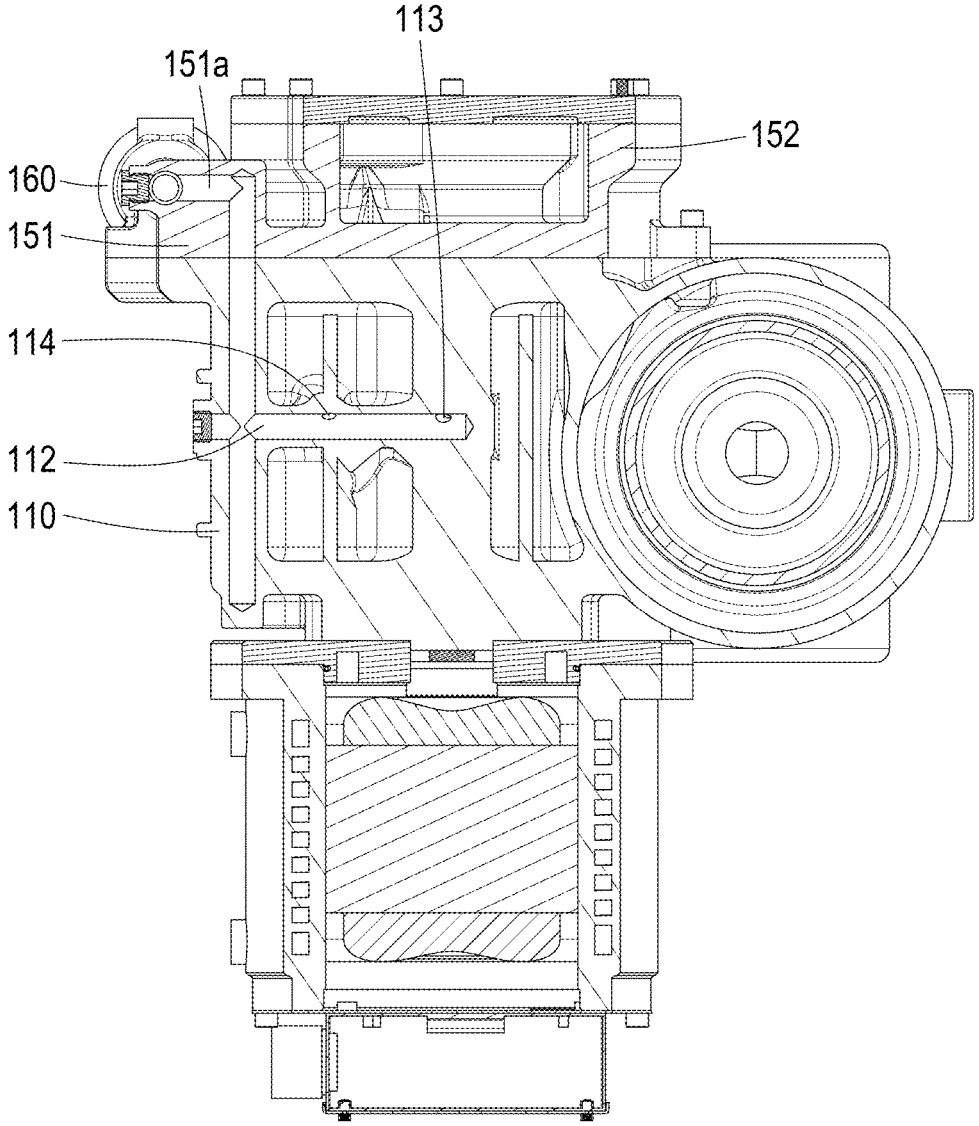
FIG. 2B is a cross-sectional schematic diagram along line segment 2B-2B of FIG. 2A.
Figure 2C:
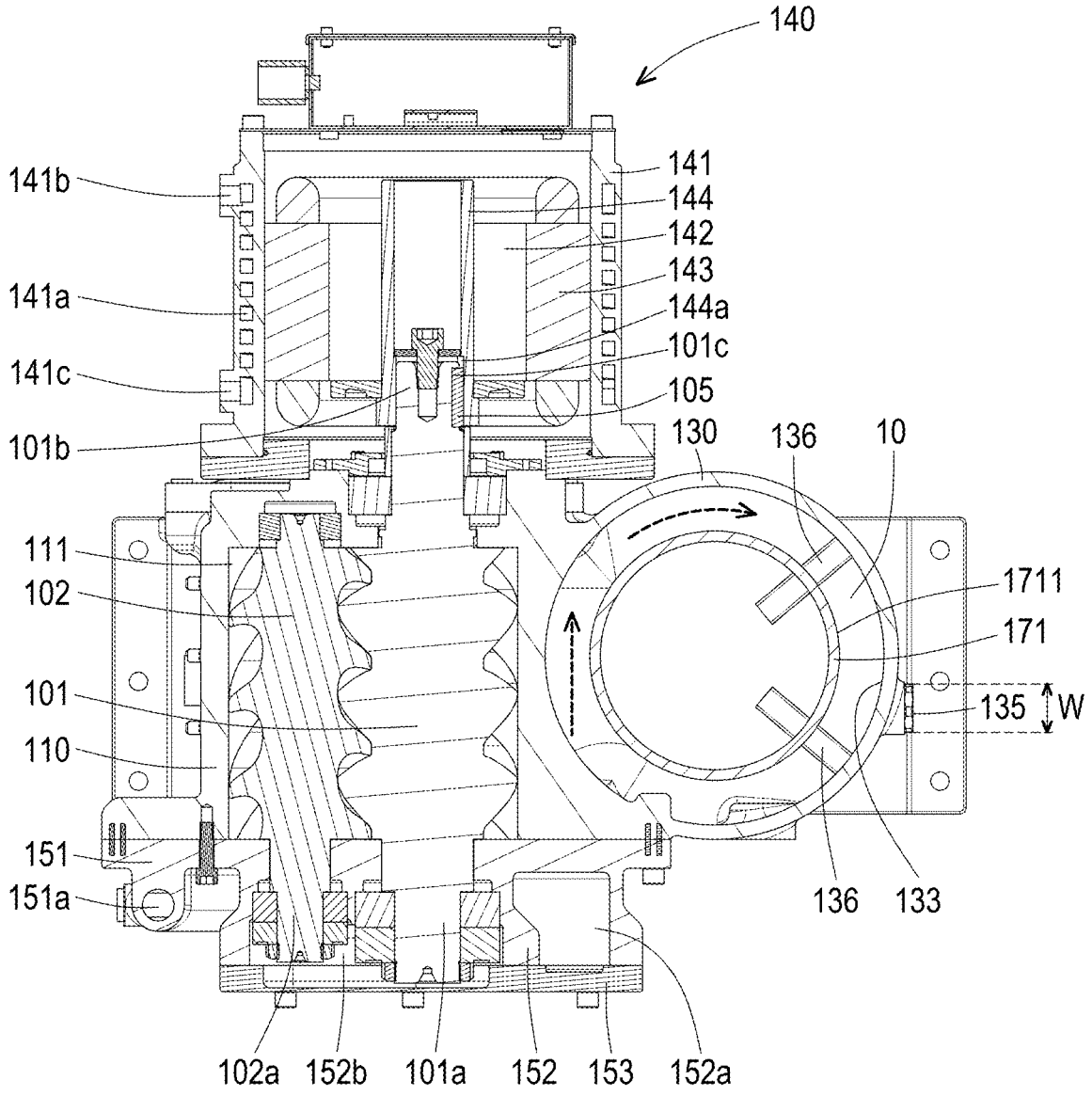
FIG. 2C is a cross-sectional schematic diagram along line segment 2C-2C of FIG. 2A.

As shown in FIG. 2C, the motor 140 includes a motor housing 141, a motor rotor 142, a motor stator 143 surrounding the motor rotor 142, and a shaft sleeve 144 interference fit and fixed inside the motor rotor 142. The motor rotor 142, the motor stator 143 and the shaft sleeve 144 are disposed in the motor housing 141, and the shaft sleeve 144 is interference fit and fixed to the docking end 101*b* of the first rotor 101. Furthermore, the compressor structure 100 further includes a key 105, in which the docking end 101*b* has a first slot 101*c*, and the shaft sleeve 144 has a second slot 144*a*. The key 105 is engaged with the first slot 101*c* and the second slot 144*a*. Therefore, the first rotor 101 and the shaft sleeve 144 use the key 105 for power transmission, and employ interference fit in the shaft hole for alignment, enabling the shaft sleeve 144 and first rotor 101 to be securely interconnected and rotate together.

As shown in FIG. 1A, FIG. 1C and FIG. 2C, the first assembly base 150 further includes a bearing base cover 153 disposed on the bearing base 152 to cover or close the bearing assembly space 152*b* and the discharge passage 152*a*. For example, the bearing base cover 153 may be fixed to the bearing base 152 by bolts, screws or other fixing parts to cover or close the bearing assembly space 152*b* and the discharge passage 152*a*, which may not only prevent oil and gas leakage, foreign matter intrusion or moisture intrusion, but also improve the convenience in cleaning, replacement or maintenance operations.

As shown in FIG. 1C, FIG. 2B, FIG. 2C and FIG. 2D, the oil filter 160 may be communicated with the compression chamber 111 through the first assembly base 150, and specifically, may be communicated with the compression chamber 111 through the oil filter base 151. In detail, the oil filter base 151 has a first internal oil passage 151*a*, and the compressor housing 110 further has a second internal oil passage 112 communicated with the compression chamber 111. The first internal oil passage 151*a* is communicated with the second internal oil passage 112, and the oil filter 160 is communicated with the compression chamber 111 through the first internal oil passage 151*a* and the second internal oil passage 112. On the other hand, the compressor housing 110 further has a first oil injection hole 113 corresponding to the first rotor 101 and a second oil injection hole 114 corresponding to the second rotor 102. The second internal oil passage 112 is communicated with the compression chamber 111 through the first oil injection hole 113 and the second oil injection hole 114.

First, solid impurities in the lubricating oil may be filtered out by the oil filter 160. Then, the lubricating oil is transported from the oil filter 160 to the first internal oil passage 151*a*, and then from the first internal oil passage 151*a* to the second internal oil passage 112. Then, the lubricating oil is injected or sprayed into the compression chamber 111 from the second internal oil passage 112 through the first oil injection hole 113 and the second oil injection hole 114 to lubricate and cool the first rotor 101 and the second rotor 102.

For example, the hole axes of the first oil injection hole 113 and the second oil injection hole 114 are not perpendicular to the long axes or rotational axes of the first rotor 101 and the second rotor 102, but are inclined to the long axes or rotational axes of the first rotor 101 and the second rotor 102. Therefore, the design of injecting or spraying the lubricating oil into the compression chamber 111 adopts an oblique injection or oblique spraying design to lubricate and cool the first rotor 101 and the second rotor 102 over a greater range.

As shown in FIG. 1A, FIG. 1E, FIG. 2C and FIG. 2E, the oil mist separator 180 may be communicated with the oil-gas barrel 130 through the second assembly base 170. In detail, the second assembly base 170 includes an oil-gas separation cylinder 171 and a barrel cover 172 connected to the oil-gas separation cylinder 171. The oil-gas separation cylinder 171 and the barrel cover 172 may be an integrally cast structure, which may not only significantly improve the structural strength, improve the manufacturing efficiency and reduce the manufacturing cost, but also improve the sealing performance to effectively reduce the oil and gas leakage phenomenon. The top portion 131 of the oil-gas barrel 130 has a top opening 131*a*, in which the second assembly base 170 is disposed on the top portion 131 and covers or closes the top opening 131*a*, specifically, the barrel cover 172 covers or closes the top opening 131*a*.

For example, the barrel cover 172 may be fixed to the top portion 131 of the oil-gas barrel 130 by bolts, screws or other fixing parts to cover or close the internal space of the oil-gas barrel 130, which may not only prevent oil and gas leakage, foreign matter intrusion or moisture intrusion, but also improve the convenience in cleaning, replacement or maintenance operations.

Figure 2D:
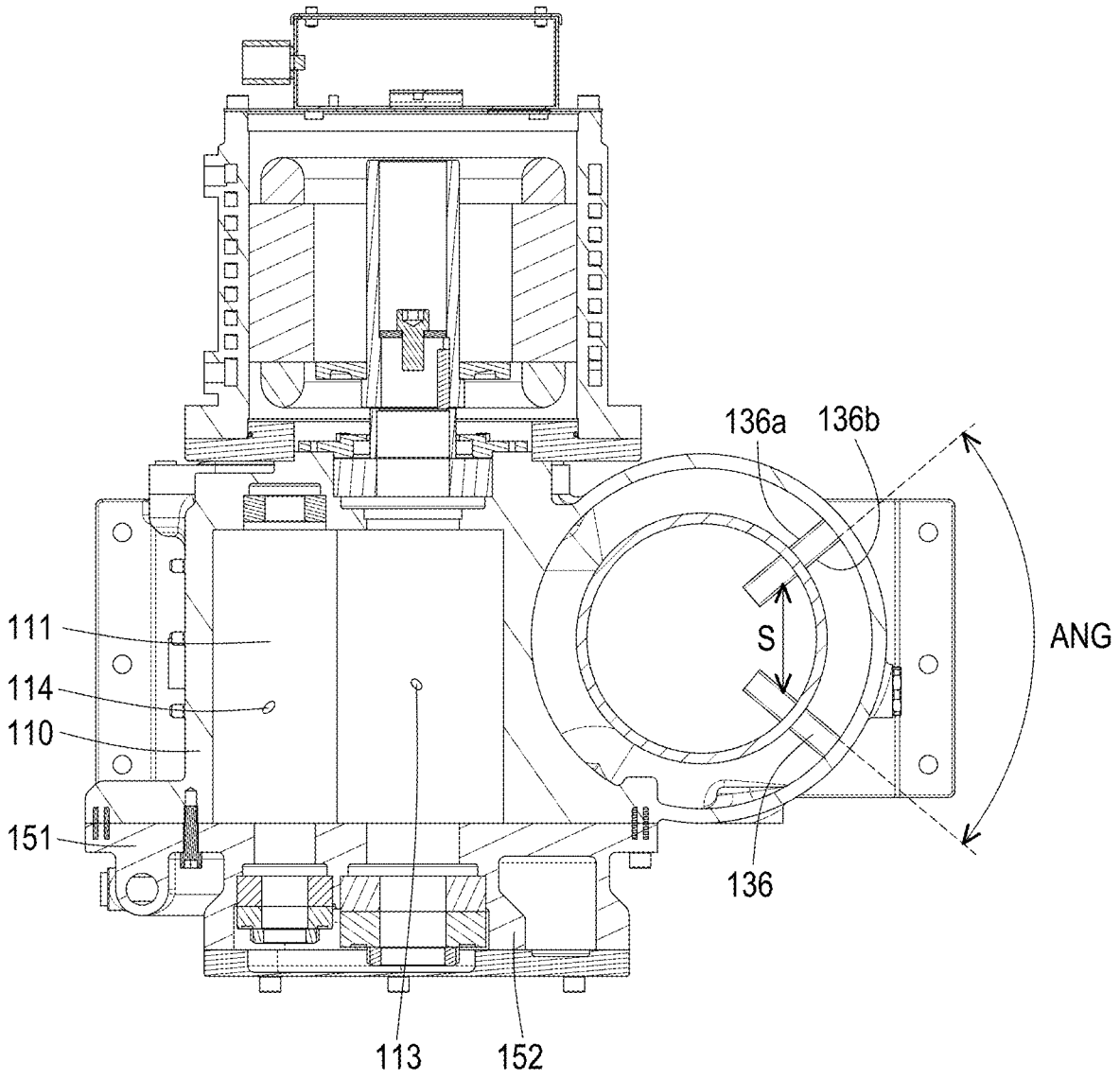
FIG. 2D is a schematic diagram showing the removal of the first rotor and the second rotor from FIG. 2C.
Figure 2E:
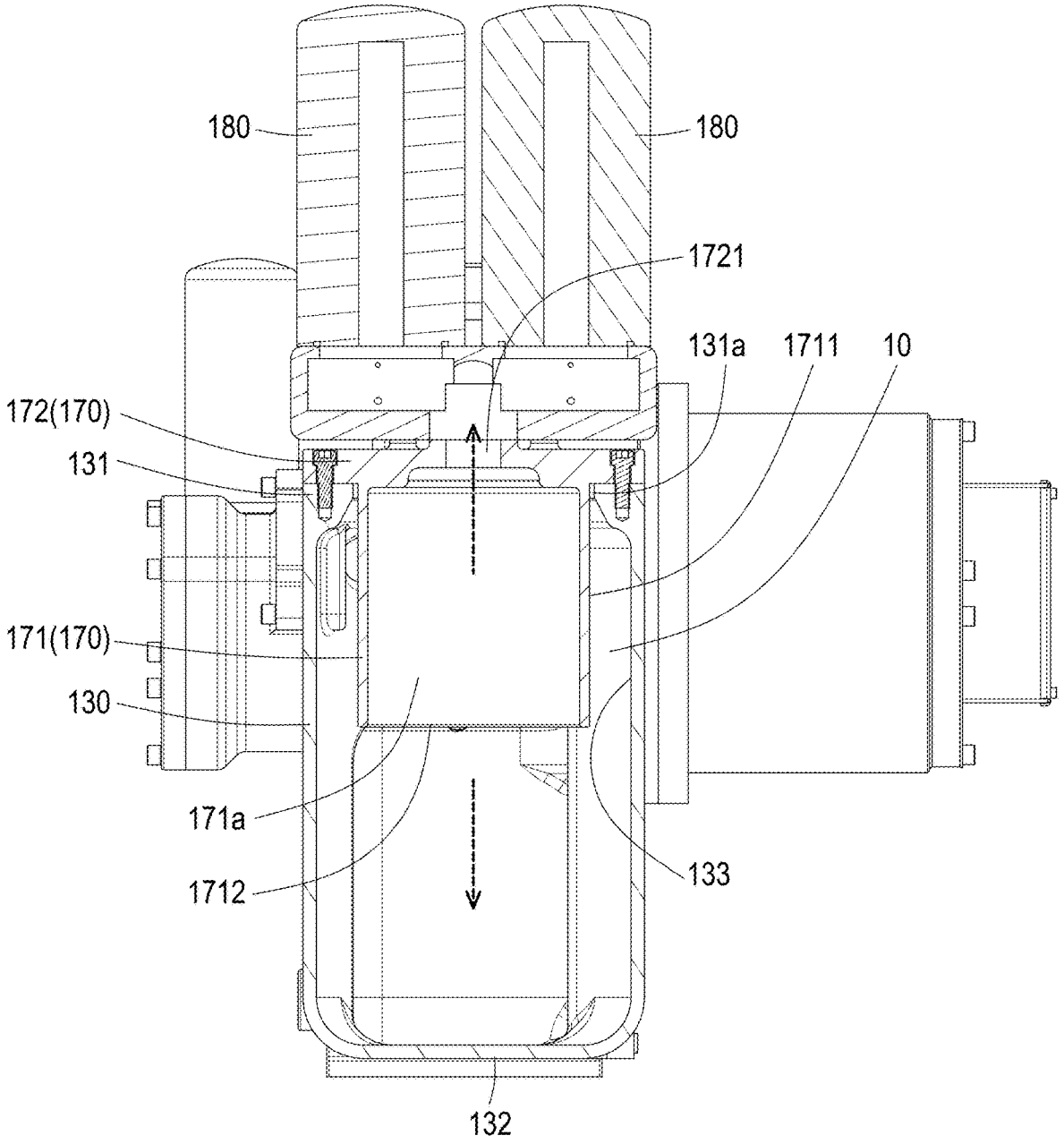
FIG. 2E is a cross-sectional schematic diagram along line segment 2E-2E of FIG. 2A.

As shown in FIG. 1E, FIG. 2C and FIG. 2E, the oil-gas separation cylinder 171 is inserted into the oil-gas barrel 130 from the top opening 131*a* and extends toward the bottom portion 132 of the oil-gas barrel 130. On the other hand, an annular flow channel 10 is formed between the inner wall surface 133 of the oil-gas barrel 130 and the outer wall surface 1711 of the oil-gas separation cylinder 171, and the discharge passage 152*a* is communicated with the annular flow channel 10. In detail, the oil-gas separation cylinder 171 may be a hollow cylinder and has an oil-gas separation space 171*a* surrounded by the annular flow channel 10. The communication position 11 of the discharge passage 152*a* and the annular flow channel 10 is close to the top opening 131*a*, and the oil-gas separation space 171*a* has a bottom opening 1712 facing the bottom portion 132. That is, the oil-gas separation space 171*a* is communicated with the internal space of the oil-gas barrel 130, and is also communicated with the annular flow channel 10.

The oil mist separator 180 is disposed on the barrel cover 172 and outside the barrel cover 172. In addition, the barrel cover 172 has an oil-gas passage 1721, and the oil-gas passage 1721 is communicated with the oil-gas separation space 171*a*. Therefore, the oil mist separator 180 may be communicated with the oil-gas separation space 171*a* through the oil-gas passage 1721, is communicated with the internal space of the oil-gas barrel 130 through the oil-gas separation space 171*a*, and is also communicated with the annular flow channel 10.

As shown in FIG. 1D, FIG. 1E, FIG. 2C and FIG. 2D, the lubricating oil injected or sprayed into the compression chamber 111 is mixed with the gas entering the compression chamber 111 and be compressed by the first rotor 101 and the second rotor 102. Then, the mixed fluid formed by the lubricating oil and the compressed gas is discharged from the compression chamber 111 and flows into the discharge passage 152*a*. Since the discharge passage 152*a* extends from bottom to top along an arc path toward the oil-gas barrel 130 at the periphery of the bearing assembly space 152*b*, the mixed fluid flowing through the discharge passage 152*a* toward the oil-gas barrel 130 is subjected to centrifugal force, whereby a portion of the lubricating oil is separated from the compressed gas, constituting a first oil-gas separation.

In this embodiment, the discharge passage 152*a* has a first port 1521 communicated with the compression chamber 111 and a second port 1522 communicated with the oil-gas barrel 130. In the gravitational direction GD, a height difference H exists between the second port 1522 and the first port 1521, specifically, the second port 1522 is higher than the first port 1521. Therefore, when the mixed fluid flows from the first port 1521 to the second port 1522, the lubricating oil separated from the compressed gas may drip to the bottom of the discharge passage 152*a* due to gravity.

Specifically, in order to render the overall configuration of the compressor structure 100 more compliant with actual application requirements, when the position of the top portion 131 of the oil-gas barrel 130 is higher than the height of the first port 1521 of the compression chamber 111, the second port 1522 of the discharge passage 152*a* is positioned higher than the first port 1521 (i.e., a height difference H exists between the second port 1522 and the first port 1521 in the gravitational direction GD), thereby enabling the mixed fluid formed by the lubricating oil and compressed gas to flow upward along the discharge passage 152*a* from bottom to top into the oil-gas barrel 130 after being discharged from the compression chamber 111. In addition, when the position of the top portion 131 of the oil-gas barrel 130 is not higher than the height of the first port 1521 of the compression chamber 111, the second port 1522 of the discharge passage 152*a* is at the same height as the first port 1521 (i.e., there is no height difference between the second port 1522 and the first port 1521 in the gravitational direction GD) or the second port 1522 of the discharge passage 152*a* is positioned lower than the first port 1521, thereby enabling the mixed fluid formed by the lubricating oil and compressed gas to be discharged from the compression chamber 111 and then smoothly enter the oil-gas barrel 130 along the discharge passage 152*a*.

Next, as shown in FIG. 1E, FIG. 2C and FIG. 2E, the mixed fluid flows into the annular flow channel 10 from the second port 1522, and flows along a spiral path from the top portion 131 to the bottom portion 132 of the oil-gas barrel 130 in the annular flow channel 10 to separate most of the lubricating oil from the compressed gas through a cyclonic separation action, constituting a second oil-gas separation. At the same time, the lubricating oil may drip to the bottom portion 132 of the oil-gas barrel 130 due to gravity. Since the oil-gas barrel 130 is communicated with the oil tank 120, the lubricating oil may be further recycled to the oil tank 120. The design of the oil-gas barrel 130 and the oil tank 120 having intercommunicating internal spaces may increase the oil storage capacity of the compressor structure 100.

As shown in FIG. 1E and FIG. 2E, after most of the lubricating oil is separated from the compressed gas, the compressed gas flows into the oil-gas separation space 171*a* from the bottom opening 1712, and then flows to the oil mist separator 180 from the oil-gas passage 1721. In detail, the oil mist separator 180 may filter out the tiny oil droplets remaining in the compressed gas to prevent the tiny oil droplets from entering the system along with the compressed gas, constituting a third oil-gas separation.

As shown in FIG. 1D, FIG. 1E, FIG. 2C and FIG. 2E, the discharge passage 152*a* is located at the bearing base 152, and the communication position 11 is located at the oil-gas barrel 130. The communication position 11 may serve as an extension of the second port 1522, that is, the communication position 11 may serve as a portion of the discharge passage 152*a*. Furthermore, one end of the discharge passage 152*a* (i.e., the first port 1521 of the discharge passage 152*a*) is communicated with the air discharge portion of the compression chamber 111, and the other end of the discharge passage 152*a* (i.e., the communication position 11) is communicated with the oil-gas barrel 130 in a tangential direction of the outer wall surface of the oil-gas barrel 130 (i.e., in a direction parallel to the tangential direction of the outer wall surface 1711 of the oil-gas separation cylinder 171).

As shown in FIG. 1A, FIG. 1B, FIG. 1C and FIG. 1E, in the present embodiment, the oil tank 120 is disposed below the compressor housing 110, and the oil-gas barrel 130 is disposed on the side of the oil tank 120. Based on this configuration, the extension path of the discharge passage 152*a* communicated with the oil-gas barrel 130 is an arc path surrounding the bearing assembly space 152*b*, and the bearing assembly space 152*b* and this arc path may be on the same plane in space.

As shown in FIG. 1B, FIG. 1E, FIG. 1F and FIG. 2C, in the present embodiment, the compressor structure 100 further includes a first external oil passage 190, a second external oil passage 191, a third external oil passage 192, and a fourth external oil passage 193. Specifically, the bottom portion 132 of the oil-gas barrel 130 has a communication port 134. One end of the first external oil passage 190 is connected to the communication port 134, and the other end of the first external oil passage 190 is connected to an external cooler 20. That is, the oil-gas barrel 130 is communicated with the external cooler 20 through the first external oil passage 190.

On the other hand, the motor housing 141 has a cooling channel 141*a*, and the cooling channel 141*a* has a first channel opening 141*b* and a second channel opening 141*c* opposite to each other. Specifically, one end of the second external oil passage 191 is connected to the external cooler 20, and the other end of the second external oil passage 191 is connected to the first channel opening 141*b*. That is, the external cooler 20 is communicated with the motor 140 through the second external oil passage 191, specifically, communicated with the cooling channel 141*a* of the motor housing 141.

In this embodiment, the oil filter base 151 has a communication port 151*b*. One end of the third external oil passage 192 is connected to the second channel opening 141*c*, and the other end of the third external oil passage 192 is connected to the communication port 151*b*. That is, the motor 140 is communicated with the oil filter 160 through the third external oil passage 192, and specifically, the cooling channel 141*a* of the motor housing 141 is communicated with the oil filter 160 through the third external oil passage 192 and the oil filter base 151.

Specifically, the first channel opening 141*b* connected to the external cooler 20 may be an input port of the cooling channel 141*a*, and correspondingly, the second channel opening 141*c* connected to the oil filter base 151 may be an output port of the cooling channel 141*a*. In other examples, the external cooler 20 may be connected to the second channel opening 141*c*, and the oil filter base 151 may be connected to the first channel opening 141*b*, so that the second channel opening 141*c* serves as an input port of the cooling channel 141*a*, and the first channel opening 141*b* serves as an output port of the cooling channel 141*a*. In other words, the input port and the output port of the cooling channel 141*a* may be interchanged according to actual application requirements without affecting the cooling effect of the motor 140.

Figure 1F:
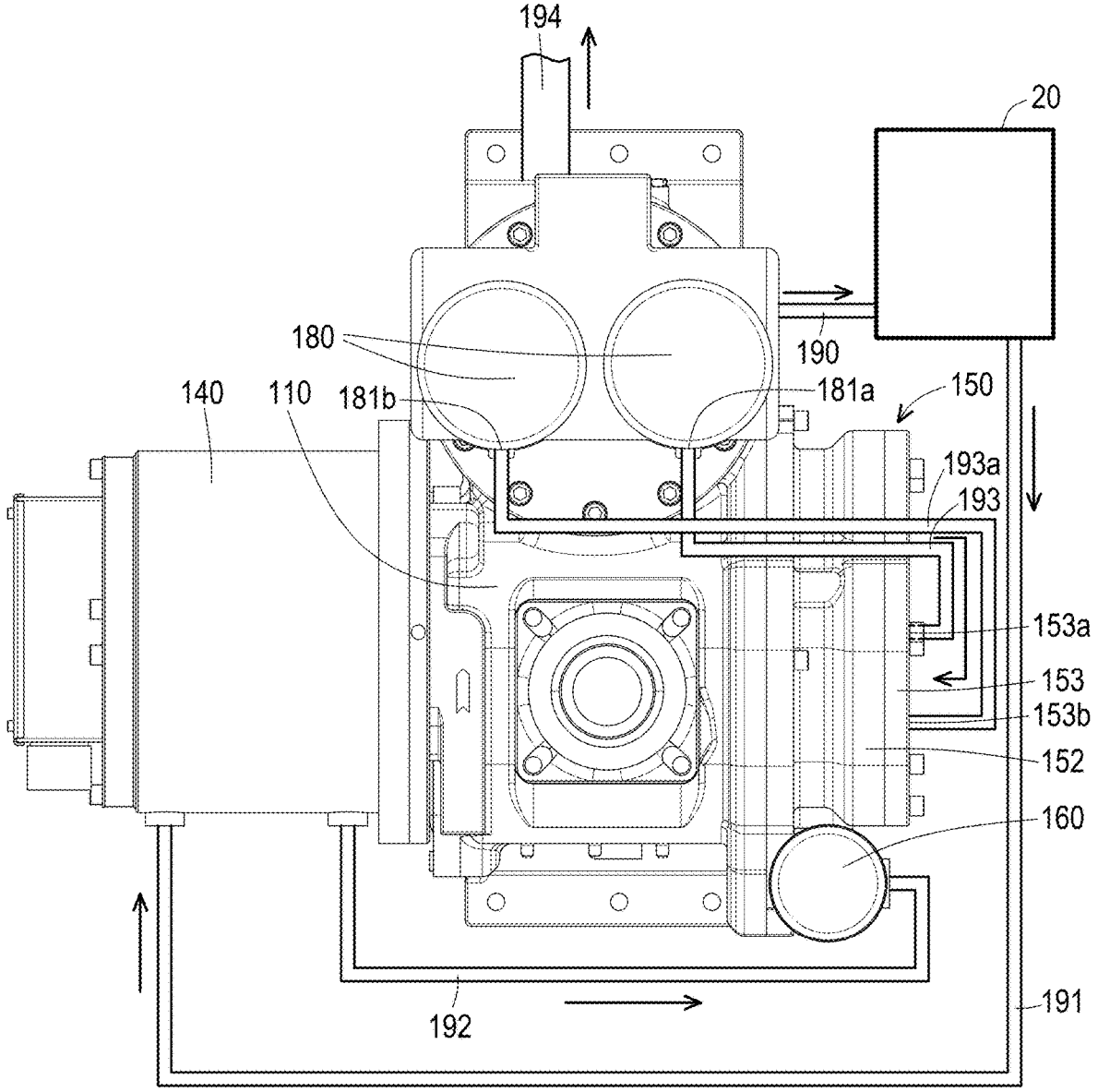
FIG. 1F is a top view schematic diagram of the flow path of the compressor structure of FIG. 1A.

As shown in FIG. 1B and FIG. 1F, in this embodiment, the bearing assembly space 152*b* of the first assembly base 150 is covered or closed by a bearing base cover 153, and the bearing base cover 153 has two communication ports 153*a* and 153*b*. On the other hand, the two oil mist separators 180 are disposed on the second assembly base 170 and are respectively communicated with the first assembly base 150, specifically with the bearing assembly space 152*b*, through two fourth external oil passages 193 and 193*a*.

Specifically, the oil mist separator 180 relatively close to the first assembly base 150 has a communication port 181*a*, and the other oil mist separator 180 relatively far from the first assembly base 150 has a communication port 181*b*. One end of the fourth external oil passage 193 is connected to the communication port 181*a*, and the other end of the fourth external oil passage 193 is connected to the communication port 153*a* relatively close to the two oil mist separators 180. In addition, one end of the fourth external oil passage 193*a* is connected to the communication port 181*b*, and the other end of the fourth external oil passage 193*a* is connected to the communication port 153*b* relatively far from the two oil mist separators 180.

As shown in FIG. 1B, FIG. 1E, FIG. 1F and FIG. 2C, the lubricating oil stored in the oil-gas barrel 130 may be transported to the external cooler 20 through the first external oil passage 190 for temperature reduction and cooling. Next, the lubricating oil after temperature reduction and cooling may be transported to the cooling channel 141*a* of the motor housing 141 through the second external oil passage 191 to reduce the temperature of the motor 140, thereby preventing the motor 140 from malfunctioning or being damaged due to excessive operating temperature.

Then, the lubricating oil in the cooling channel 141*a* may be transported to the oil filter 160 through the third external oil passage 192 and the oil filter base 151, and solid impurities in the lubricating oil may be filtered out by the oil filter 160. Next, as shown in FIG. 2B to FIG. 2D, the lubricating oil is transported from the oil filter 160 to the first internal oil passage 151*a*, and then transported from the first internal oil passage 151*a* to the second internal oil passage 112. Then, the lubricating oil is injected or sprayed into the compression chamber 111 from the second internal oil passage 112 via the first oil injection hole 113 and the second oil injection hole 114 to lubricate and cool the first rotor 101 and the second rotor 102.

Then, as shown in FIG. 1D, FIG. 1E, FIG. 2C and FIG. 2E, the mixed fluid formed by the lubricating oil and the compressed gas is discharged from the compression chamber 111 and flows through the discharge passage 152*a* and the annular flow channel 10 in sequence to perform the first oil-gas separation and the second oil-gas separation in sequence. Next, the compressed gas flows into the oil-gas separation space 171*a* from the bottom opening 1712, and then flows to the two oil mist separators 180 via the oil-gas passage 1721 for the third oil-gas separation.

As shown in FIG. 1B, FIG. 1F and FIG. 2E, after the two oil mist separators 180 filter out the tiny oil droplets remaining in the compressed gas, the oil droplets may be transported to the bearing assembly space 152*b* through the fourth external oil passages 193 and 193*a* to lubricate the first bearing 103 and the second bearing 104. As shown in FIG. 1A, FIG. 1F and FIG. 2E, the oil mist separator 180 has a communication port 182 connected to the external air passage 194, whereby the oil mist separator 180 is communicated with the system through the external air passage 194. After the two oil mist separators 180 filter out the tiny oil droplets remaining in the compressed gas, the compressed gas with low oil content may be transported to the system through the external air passage 194.

Through the flow path design in the compressor structure 100, the lubricating oil may be fully utilized and recycled, and most of the lubricating oil may be separated from the compressed gas to prevent the compressed gas with high oil content from entering the system, while reducing the lubricating oil consumption.

In this embodiment, after the two oil mist separators 180 filter out the tiny oil droplets remaining in the compressed gas, the oil droplets may enter the fourth external oil passage 193 via the communication port 181*a*. At the same time, the oil droplets may enter the fourth external oil passage 193*a* via the communication port 181*b*. Then, the oil droplets may be transported to the communication port 153*a* through the fourth external oil passage 193, so as to be transported to the bearing assembly space 152*b* via the communication port 153*a*. At the same time, the oil droplets may be transported to the communication port 153*b* through the fourth external oil passage 193*a*, so as to be transported to the bearing assembly space 152*b* via the communication port 153*b*. Therefore, the oil droplets filtered by the two oil mist separators 180 may be transported to the bearing assembly space 152*b* via two transport paths.

In other examples, the two oil mist separators 180 may share a single communication port, and the bearing base cover 153 has a single communication port. On the other hand, the communication port shared by the two oil mist separators 180 is connected to the communication port of the bearing base cover 153 through a single fourth external oil passage to communicate with the bearing assembly space 152*b*. Therefore, the oil droplets filtered by the two oil mist separators 180 may be transported to the bearing assembly space 152*b* via a single transport path.

In other examples, the two communication ports of the two oil mist separators 180 are respectively connected to the two fourth external oil passages, and the two fourth external oil passages are connected to a communication port of the bearing base cover 153 through a common valve or a common communication pipe. In actual application, the oil mist separator 180, the communication port of the bearing base cover 153 and one or more fourth external oil passages cooperating therewith are configured in accordance with the design requirements of different compressor models.

Referring to FIG. 1E and FIG. 2C to FIG. 2E, in this embodiment, the oil-gas barrel 130 further includes an oil sight glass 135. The oil sight glass 135 is disposed between the top portion 131 and the bottom portion 132 and close to the lower half of the oil-gas barrel 130 to facilitate observation of the lubricating oil surface level in the oil-gas barrel 130 and thus determine the lubricating oil quantity. On the other hand, two rectifying plates 136 corresponding to the oil sight glass 135 are provided inside the oil-gas barrel 130. The two rectifying plates 136 are located between the oil sight glass 135 and the oil tank 120, and extend from the bottom portion 132 to the top portion 131 or extend upward.

When the mixed fluid is subjected to cyclonic separation in the annular flow channel 10 or the lubricating oil drips to the bottom portion 132, the liquid surface of the lubricating oil in the oil-gas barrel 130 will be disturbed, causing the liquid surface to fluctuate. Due to the two rectifying plates 136 being capable of blocking or attenuating the fluctuations transmitted toward the oil sight glass 135, excessive undulation of the lubricating oil surface level in the vicinity of the oil sight glass 135 is prevented, thereby reducing instances of erroneous assessment of the lubricating oil quantity.

It is particularly noted that the two rectifying plates 136 are not limited to being protruded from the bottom portion 132, but may also be protruded from other positions in the lower half of the oil-gas barrel 130, such as protruded from the inner wall surface 133 of the oil-gas barrel 130 connected to the bottom portion 132, but not contacting the bottom portion 132, or other positions on the path that may block the fluctuation of the liquid surface from being transmitted to the oil sight glass 135.

On the other hand, the present embodiment is described by providing two rectifying plates 136 close to the oil sight glass 135 and roughly located at two opposite sides of the oil sight glass 135. However, in response to other design requirements, the two rectifying plates 136 and the oil sight glass 135 may be disposed close to the bearing base 152 or the motor 140 to facilitate personnel observation.

As shown in FIG. 1E, FIG. 2C and FIG. 2D, a gap S exists between the two rectifying plates 136, and the gap S gradually expands from the oil tank 120 toward the oil sight glass 135. When the fluctuations generated by the liquid surface of the lubricating oil stored in the oil-gas barrel 130 are transmitted to the oil sight glass 135, as the gap S gradually expands, the wave speed gradually decreases and the fluctuations gradually attenuated. For example, the smallest gap in the gap S farthest from the oil sight glass 135 may be ½ times the width W of the oil sight glass 135, and the largest gap in the gap S closest to the oil sight glass 135 may be 3 times the width W of the oil sight glass 135. That is, the size of the gap S is between ½ and 3 times of the width W.

On the other hand, each rectifying plate 136 has a first surface 136*a* facing the oil tank 120 and a second surface 136*b* facing the oil sight glass 135, and an included angle ANG between the two second surfaces 136*b* of the two rectifying plates 136 is between 30 degrees and 180 degrees. When the liquid surface of the lubricating oil in the oil-gas barrel 130 fluctuates, the two first surfaces 136*a* of the two rectifying plates 136 may block or attenuate the fluctuation transmitted to the oil sight glass 135.

Figure 3:
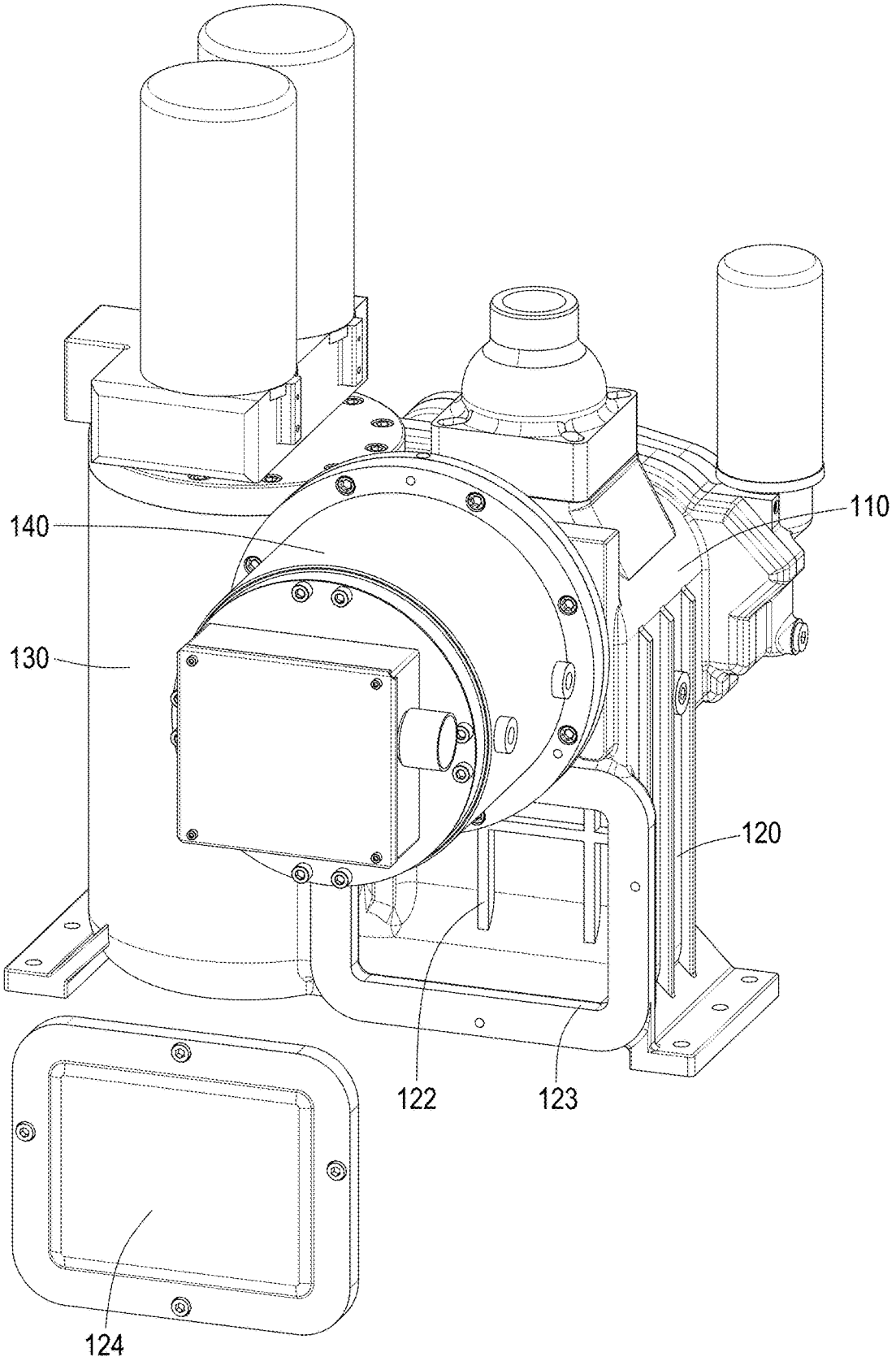
FIG. 3 is a partial exploded schematic diagram of FIG. 1A at another viewing angle.

As shown in FIG. 1A, FIG. 1B and FIG. 3, multiple outer linear ribs 121 are disposed in parallel on the outside of the oil tank 120 to improve the structural strength. In addition, multiple intersecting inner linear ribs 122, such as cross ribs, are disposed inside the oil tank 120 to improve the structural strength. In this embodiment, the oil tank 120 has an oil tank opening 123 located below the motor 140, and the oil tank 120 is provided with an oil tank cover 124 to facilitate the machining of the first oil injection hole 113 and the second oil injection hole 114, etc., by utilizing the internal space of the oil tank 120, and then closing the oil tank opening 123. For example, the oil tank cover 124 may be fixed to the oil tank 120 by bolts, screws or other fixing parts to cover or close the oil tank opening 123, which may not only prevent oil and gas leakage, foreign matter intrusion or moisture intrusion, but also improve the convenience in cleaning, replacement or maintenance operations.

Figure 4:
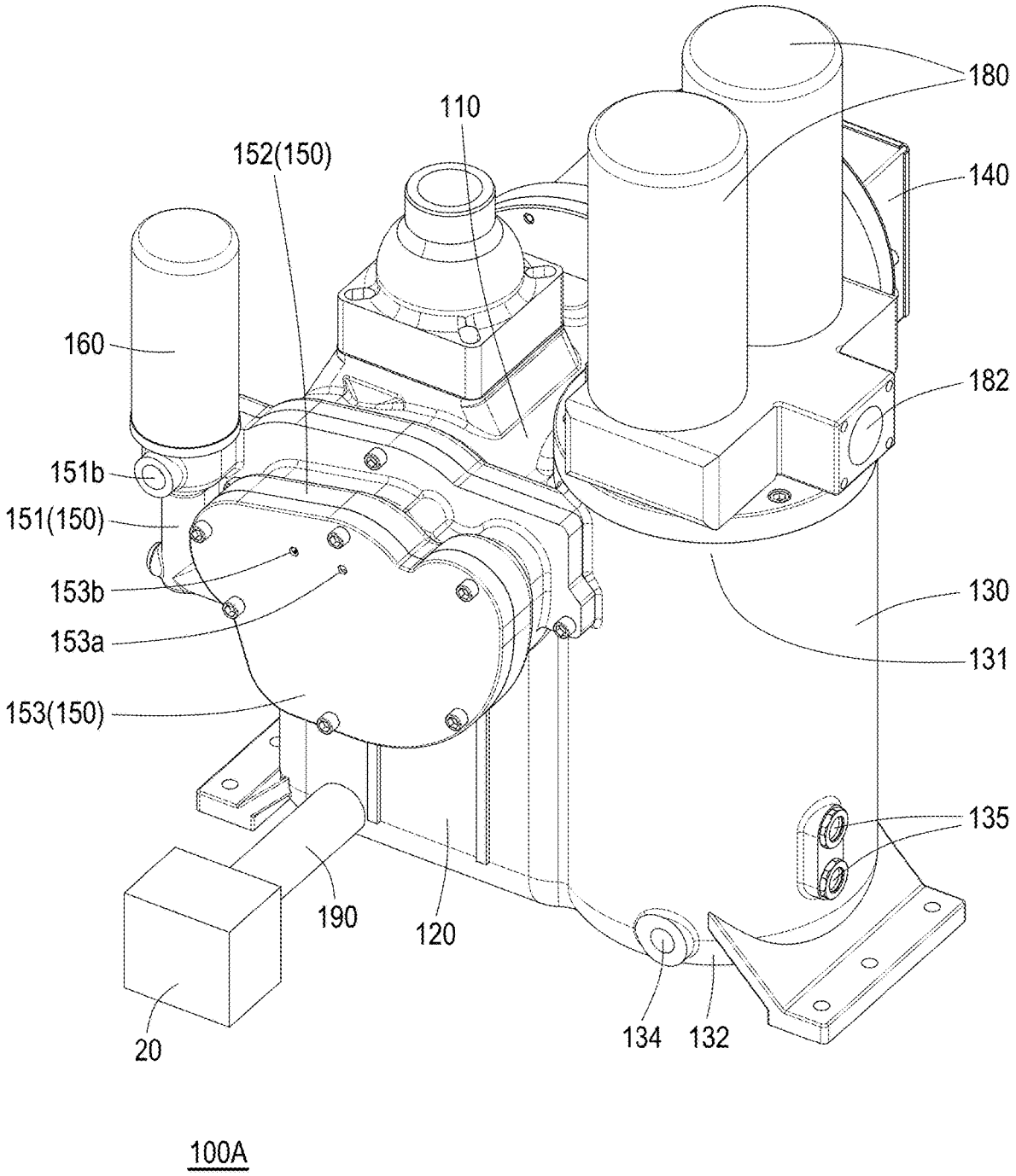
FIG. 4 is a schematic diagram showing the configuration of an oil tank and an external cooler of a compressor structure of another embodiment of the disclosure.

FIG. 4 is a schematic diagram showing the configuration of an oil tank and an external cooler of a compressor structure of another embodiment of the disclosure. In the compressor structure 100 of the previous embodiment, the oil-gas barrel 130 is communicated with the external cooler 20 through the first external oil passage 190. Referring to FIG. 4, in the compressor structure 100A of this embodiment, the first external oil passage 190 may be connected between the oil tank 120 and the external cooler 20. That is, the oil tank 120 is communicated with the external cooler 20 through the first external oil passage 190, so that the lubricating oil stored in the oil tank 120 is transported to the external cooler 20 through the first external oil passage 190 for temperature reduction and cooling.

Figure 5:
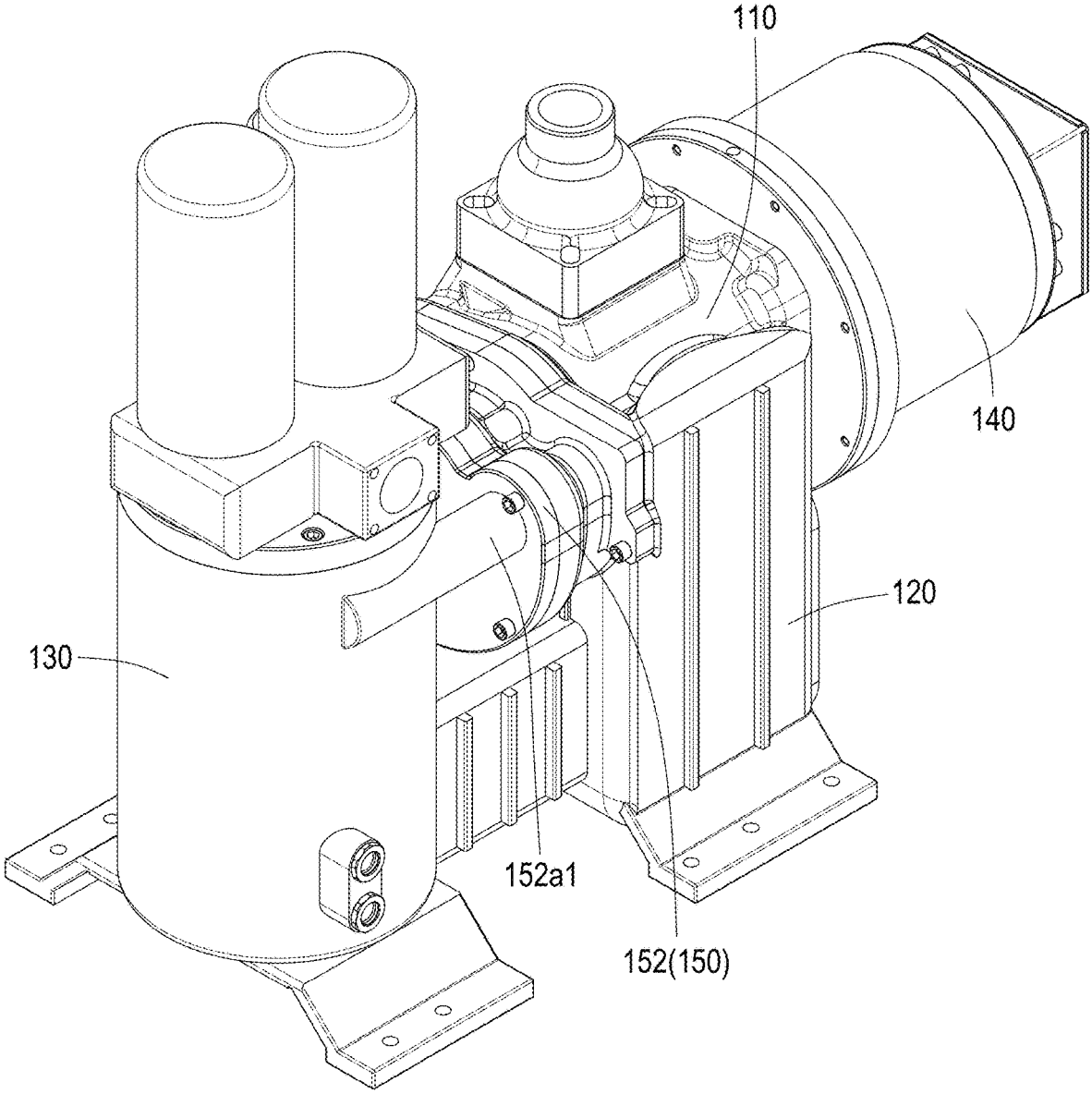
FIG. 5 is a schematic diagram of a compressor structure of yet another embodiment of the disclosure.

FIG. 5 is a schematic diagram of a compressor structure of yet another embodiment of the disclosure. Referring to FIG. 5, different from the compressor structure 100 shown in FIG. 1A to FIG. 1C, in the compressor structure 100B of this embodiment, the motor 140 and the first assembly base 150 are respectively disposed at two opposite sides of the compressor housing 110, and the bearing base 152 is disposed between the oil-gas barrel 130 and the compressor housing 110. That is, the oil-gas barrel 130 is disposed opposite to the motor 140 through the bearing base 152. Based on this configuration, an discharge passage 152*a*1 extends from the bearing base 152 to the oil-gas barrel 130 to be communicated with the oil-gas barrel 130, and is located on a different plane in space from the bearing base 152 and the bearing assembly space therein.

To sum up, in the compressor structure of the disclosure, the mixed fluid formed by the lubricating oil and the compressed gas, after being discharged from the compression chamber, first undergoes a first oil-gas separation through centrifugal force action in the discharge passage. Subsequently, the mixed fluid enters the oil-gas barrel from the discharge passage and undergoes a second oil-gas separation through cyclonic separation action in the oil-gas barrel, thereby separating the majority of the lubricating oil from the compressed gas. Next, the compressed gas flows into the oil-gas separation space from the bottom opening, and then flows to the oil mist separator via the oil-gas port for a third oil-gas separation. That is, unlike the conventional compressor structure that directly delivers the mixed fluid from the compression chamber into the oil tank for oil-gas separation, the compressor structure of the disclosure adopts three oil-gas separation procedures to significantly reduce the oil content of the compressed gas. Therefore, the compressor structure of the disclosure may not only prevent compressed gas with high oil content from entering the system, but also reduce the lubricating oil consumption.

On the other hand, the oil tank is disposed below the compressor housing, in which the oil-gas barrel is communicated with the oil tank, and the compressor housing and the oil tank are located at the same side of the oil-gas barrel, thereby improving the compactness of the structural configuration to reduce the volume and increasing the oil storage capacity of the compressor structure. Furthermore, the oil-gas barrel is internally equipped with rectifying plates configured to block or attenuate fluctuations transmitted toward the oil sight glass, thereby preventing excessive undulation of the lubricating oil surface level in the vicinity of the oil sight glass, so as to reduce instances of erroneous assessment of lubricating oil quantity. Additionally, the lubricating oil after temperature reduction and cooling may first cool the motor, and thereafter be injected or sprayed into the compression chamber to lubricate and cool the first rotor and the second rotor, thereby substantially enhancing the integration of the oil passage and the utilization efficiency of the lubricating oil.

Although the disclosure has been described in detail with reference to the above embodiments, they are not intended to limit the disclosure. Those skilled in the art should understand that it is possible to make changes and modifications without departing from the spirit and scope of the disclosure. Therefore, the protection scope of the disclosure shall be defined by the following claims.

What is claimed is:

1. A compressor structure, comprising:

a compressor housing, having a compression chamber;

an oil tank, disposed below the compressor housing;

an oil-gas barrel, communicated with the oil tank, wherein the compressor housing and the oil tank are located at a same side of the oil-gas barrel;

a motor;

a first assembly base, wherein the motor and the first assembly base are respectively disposed at two opposite sides of the compressor housing, wherein the first assembly base has a discharge passage, and the compression chamber is communicated with the oil-gas barrel through the discharge passage;

at least one oil filter, disposed on the first assembly base and communicated with the compression chamber through the first assembly base;

a second assembly base, disposed on the oil-gas barrel; and at least one oil mist separator, disposed on the second assembly base and communicated with the oil-gas barrel through the second assembly base.

2. The compressor structure according to claim 1, wherein the oil-gas barrel comprises a top portion and a bottom portion, and the top portion has a top opening, the second assembly base comprises a barrel cover and an oil-gas separation cylinder, and the barrel cover and the oil-gas separation cylinder are formed as an integrally cast structure, the barrel cover covers the top opening, and the oil mist separator is disposed on the barrel cover, the oil-gas separation cylinder is inserted into the oil-gas barrel from the top opening and extends toward the bottom portion, wherein an annular flow channel is formed between an inner wall surface of the oil-gas barrel and an outer wall surface of the oil-gas separation cylinder, and the discharge passage is communicated with the annular flow channel.

3. The compressor structure according to claim 2, wherein a communication position of the discharge passage and the annular flow channel is close to the top opening, and the oil-gas separation cylinder has an oil-gas separation space surrounded by the annular flow channel, the oil-gas separation space has a bottom opening facing the bottom portion, wherein the oil mist separator is communicated with the oil-gas barrel through the oil-gas separation space, the barrel cover has an oil-gas passage, and the oil mist separator is communicated with the oil-gas separation space through the oil-gas passage.

4. The compressor structure according to claim 2, wherein the first assembly base comprises an oil filter base, a bearing base, and a bearing base cover, the oil filter is disposed on the oil filter base and is communicated with the compression chamber through the oil filter base, the first assembly base further has a bearing assembly space separated from the discharge passage, and the discharge passage and the bearing assembly space are formed on the bearing base, wherein the bearing base cover is disposed on the bearing base and covers the bearing assembly space and the discharge passage.

5. The compressor structure according to claim 4, further comprising:

a first rotor, coupled to the motor, wherein the motor comprises a motor rotor, a motor stator surrounding the motor rotor, and a shaft sleeve interference fit and fixed inside the motor rotor, and the shaft sleeve is interference fit and fixed to a docking end of the first rotor;

a key, wherein the docking end has a first slot, and the shaft sleeve has a second slot, the key is engaged with the first slot and the second slot;

a second rotor, wherein the second rotor and the first rotor are disposed in the compression chamber and mesh with each other; and a first bearing and a second bearing, disposed in the bearing assembly space, wherein one end of the first rotor is inserted into the bearing assembly space, and the first bearing is sleeved on the end of the first rotor, and one end of the second rotor is inserted into the bearing assembly space, and the second bearing is sleeved on the end of the second rotor.

6. The compressor structure according to claim 4, wherein the discharge passage surrounds the bearing assembly space, and a concave arc side of the discharge passage faces the bearing assembly space, wherein the discharge passage has a first port communicated with the compression chamber and a second port communicated with the oil-gas barrel, and a height difference or no height difference exists between the second port and the first port in a gravitational direction.

7. The compressor structure according to claim 4, wherein one end of the discharge passage is communicated with an air discharge portion of the compression chamber, and another end of the discharge passage is communicated with the oil-gas barrel in a tangential direction of the outer wall surface of the oil-gas barrel.

8. The compressor structure according to claim 7, wherein a portion of the discharge passage surrounds the bearing assembly space.

9. The compressor structure according to claim 4, wherein the oil filter base has a first internal oil passage, and the compressor housing further has a second internal oil passage communicated with the compression chamber, the first internal oil passage is communicated with the second internal oil passage, and the oil filter is communicated with the compression chamber through the first internal oil passage and the second internal oil passage, wherein the compressor housing further has at least one oil injection hole, and the second internal oil passage is communicated with the compression chamber through the at least one oil injection hole.

10. The compressor structure according to claim 1, wherein the oil-gas barrel comprises a top portion, a bottom portion, and an oil sight glass, and the second assembly base is disposed on the top portion, the oil sight glass is disposed between the top portion and the bottom portion and close to a lower half of the oil-gas barrel wherein two rectifying plates corresponding to the oil sight glass are provided inside the oil-gas barrel, and the two rectifying plates are located between the oil sight glass and the oil tank, wherein a gap exists between the two rectifying plates, and the gap gradually expands from the oil tank toward the oil sight glass.

11. The compressor structure according to claim 10, wherein a smallest gap in the gap farthest from the oil sight glass is ½ to 3 times a width of the oil sight glass.

12. The compressor structure according to claim 10, wherein each of the rectifying plates has a first surface facing the oil tank and a second surface facing the oil sight glass, and an included angle between the two second surfaces of the two rectifying plates is between 30 degrees and 180 degrees.

13. The compressor structure according to claim 10, wherein two rectifying plates corresponding to the oil sight glass are provided inside the oil-gas barrel, and the two rectifying plates extend upward from the bottom portion.

14. The compressor structure according to claim 10, wherein two rectifying plates corresponding to the oil sight glass are provided inside the oil-gas barrel, and the two rectifying plates are protruded from an inner wall surface in the oil-gas barrel connected to the bottom portion.

15. The compressor structure according to claim 1, wherein a plurality of outer linear ribs are disposed in parallel on the outside of the oil tank, and a plurality of intersecting inner linear ribs are disposed inside the oil tank.

16. The compressor structure according to claim 1, further comprising:

a first external oil passage, wherein the oil-gas barrel is communicated with an external cooler through the first external oil passage;

a second external oil passage, wherein the external cooler is communicated with the motor through the second external oil passage;

a third external oil passage, wherein the motor is communicated with the oil filter through the third external oil passage; and at least one fourth external oil passage, wherein the oil mist separator is communicated with the first assembly base through the at least one fourth external oil passage.

17. The compressor structure according to claim 16, wherein the first assembly base further has a bearing assembly space separated from the discharge passage, and the at least one fourth external oil passage is communicated with the bearing assembly space.

18. The compressor structure according to claim 16, wherein the motor comprises a motor housing, and the motor housing has a cooling channel, the external cooler is communicated with an input port of the cooling channel through the second external oil passage, and an output port of the cooling channel is communicated with the oil filter through the third external oil passage.

19. The compressor structure according to claim 1, wherein the oil tank has an oil tank opening located below the motor, and the oil tank is provided with an oil tank cover for closing the oil tank opening.

20. The compressor structure according to claim 1, further comprising:

an external oil passage, wherein the oil tank is communicated with an external cooler through the external oil passage.

* * * * *